US010555614B2

(12) United States Patent
Huang

(10) Patent No.: US 10,555,614 B2
(45) **Date of Patent: *Feb. 11, 2020**

(54) BOTTOM BED COMBINATION

(71) Applicant: APEX HEALTH CARE MFG. INC., Minxiong Township, Chiayi County (TW)

(72) Inventor: Chi-Chung Huang, Minxiong Township (TW)

(73) Assignee: Apex Health Care Mfg. Inc., Chiayi County (TW)

( * ) Notice: Subject to any disclaimer, the term of this patent is extended or adjusted under 35 U.S.C. 154(b) by 74 days.

This patent is subject to a terminal disclaimer.

(21) Appl. No.: 15/798,566

(22) Filed: Oct. 31, 2017

(65) Prior Publication Data

US 2019/0125088 A1 May 2, 2019

(51) Int. Cl.
*A47C 19/00* (2006.01)
*A47C 20/04* (2006.01)
*A47C 19/02* (2006.01)

(52) U.S. Cl.
CPC ..... *A47C 19/005* (2013.01); *A47C 19/025* (2013.01); *A47C 20/041* (2013.01)

(58) Field of Classification Search
CPC ... A47C 19/005; A47C 19/025; A47C 19/024; A47C 20/041; F16B 12/30; F16B 12/24
See application file for complete search history.

(56) References Cited

U.S. PATENT DOCUMENTS

| | | | | |
|---|---|---|---|---|
| 4,685,160 | A * | 8/1987 | Rizzardo | A47C 19/005 5/201 |
| 5,257,428 | A * | 11/1993 | Carroll | A47C 19/122 5/201 |
| 6,073,286 | A * | 6/2000 | Wu | A47C 19/122 5/616 |
| 7,237,289 | B2 * | 7/2007 | Loewenthal | A47C 19/04 108/158.12 |
| 9,226,588 | B2 * | 1/2016 | McCarty | A47C 19/028 |
| 9,668,587 | B1 * | 6/2017 | Huang | A47C 19/025 |
| 2010/0229303 | A1 * | 9/2010 | Goldsmith | A47C 19/005 5/285 |
| 2012/0168328 | A1 * | 7/2012 | Chen | A47C 19/005 206/223 |
| 2014/0259396 | A1 * | 9/2014 | McCarty | A47C 19/005 5/400 |
| 2016/0206111 | A1 * | 7/2016 | Oh | A47C 19/122 |
| 2016/0316919 | A1 * | 11/2016 | Goldsmith | A47C 20/041 |

* cited by examiner

*Primary Examiner* — Eric J Kurilla
*Assistant Examiner* — Rahib T Zaman
(74) *Attorney, Agent, or Firm* — Alan D. Kamrath; Mayer & Williams PC

(57) ABSTRACT

A bottom bed combination includes a first bed bottom, a second bed bottom, two fastening units and a plurality of stands. The first bed bottom includes a first bed frame, a first bed board, a plurality of first bases a first linkage and a first electric cylinder. The second bed bottom includes a second bed frame, a second bed board, a plurality of second bases, a second linkage and a second electric cylinder. Each of the fastening units includes a mount mounted on the first bed frame and the second bed frame, and a pin extending through the mount, the first bed frame and the second bed frame. The stands are respectively secured on the first bases, the second bases and the fastening units.

6 Claims, 12 Drawing Sheets

BOTTOM BED COMBINATION

BACKGROUND OF THE INVENTION

1. Field of the Invention

The present invention relates to a bed and, more particularly, to a bottom bed combination.

2. Description of the Related Art

A conventional bottom bed has a larger size and cannot be dismantled, thereby causing inconvenience in and increasing the cost of packaging, storage and transportation of the bottom bed. A conventional bottom bed combination comprises a front bed bottom and a rear bed bottom detached from the front bed bottom. The conventional bottom bed combination further comprises a linkage and an electric cylinder located under the front bed bottom and the rear bed bottom. The front bed bottom has a convex portion, and the rear bed bottom has a concave portion engaging the convex portion of the front bed bottom to combine the front bed bottom and the rear bed bottom. Thus, the conventional bottom bed combination is divided into the front bed bottom and the rear bed bottom, thereby facilitating packaging, storage and transportation of the conventional bottom bed combination. However, the linkage and the electric cylinder are located under the front bed bottom and the rear bed bottom, thereby causing inconvenience in assembly of the conventional bottom bed combination.

BRIEF SUMMARY OF THE INVENTION

In accordance with the present invention, there is provided a bottom bed combination comprising a first bed bottom, a second bed bottom, two fastening units and a plurality of stands. The first bed bottom includes a first bed frame and a first bed board. The first bed frame is provided with a plurality of first bases. The first bed frame has a lower portion provided with a first linkage and a first electric cylinder. The second bed bottom includes a second bed frame juxtaposed to the first bed frame and a second bed board juxtaposed to the first bed board. The second bed frame is provided with a plurality of second bases. The second bed frame has a lower portion provided with a second linkage and a second electric cylinder. Each of the two fastening units includes a mount mounted on the first bed frame and the second bed frame, and a pin extending through the mount, the first bed frame and the second bed frame, to connect the first bed frame and the second bed frame by the mount. The stands are respectively secured on the first bases of the first bed frame, the second bases of the second bed frame and the mount of each of the two fastening units.

According to the primary advantage of the present invention, the first bed bottom and the second bed bottom are detached before assembly, to facilitate and decrease the cost of packaging, storage and transportation of the bottom bed combination.

According to another advantage of the present invention, the first bed bottom and the second bed bottom are combined together by the two fastening units, so that the user can mount the bottom bed combination by himself/herself.

According to a further advantage of the present invention, the first bed bottom and the second bed bottom are assembled and disassembled easily and quickly, thereby facilitating the user assembling and disassembling the bottom bed combination.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
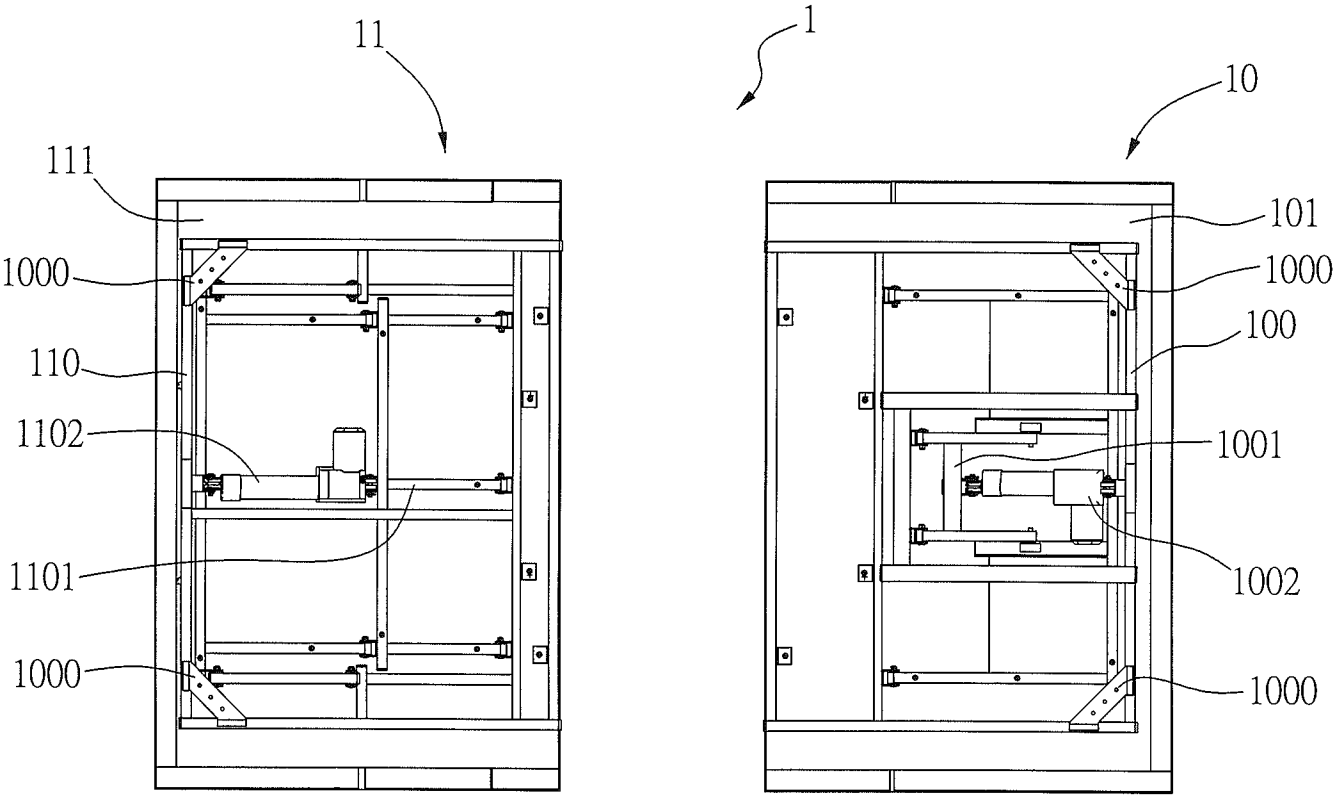
FIG. 1 is an exploded bottom view of a bottom bed combination in accordance with the preferred embodiment of the present invention.
Figure 2:
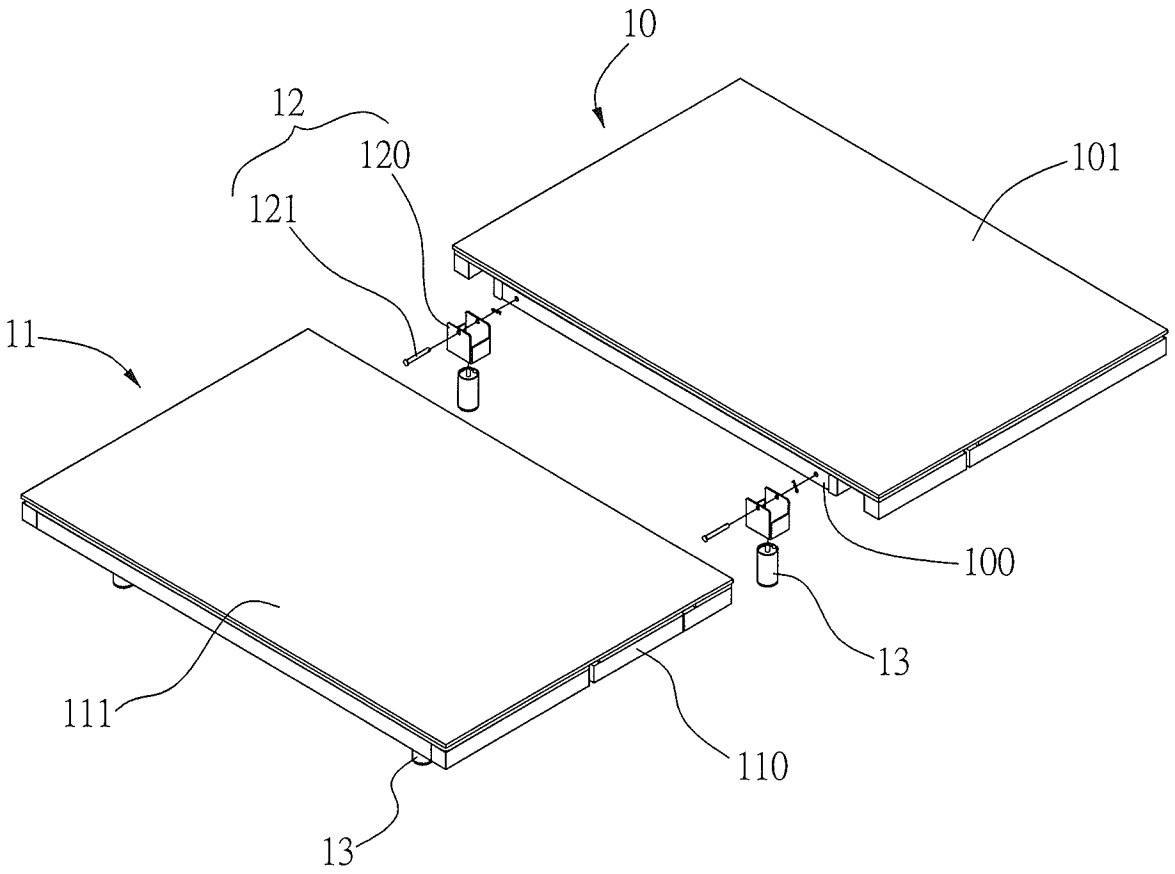
FIG. 2 is an exploded perspective view of the bottom bed combination in accordance with the preferred embodiment of the present invention.
Figure 3:
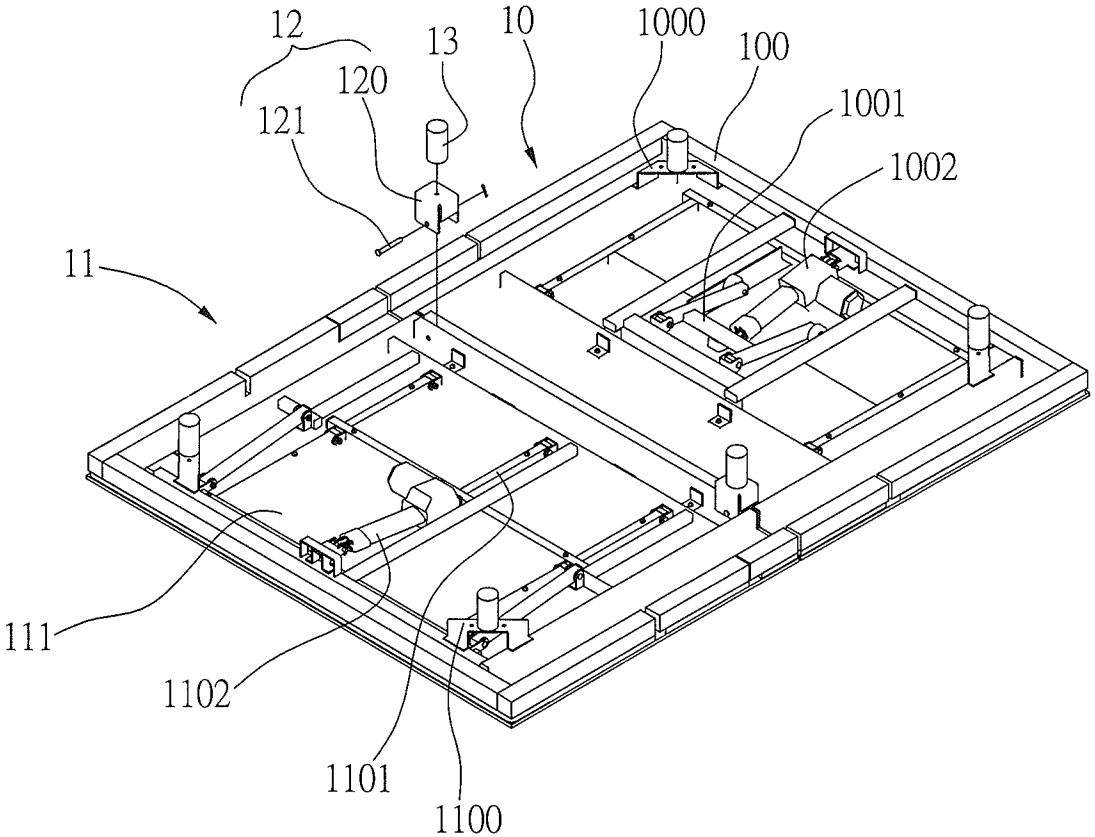
FIG. 3 is a partially exploded bottom perspective view of the bottom bed combination in accordance with the preferred embodiment of the present invention.
Figure 4:
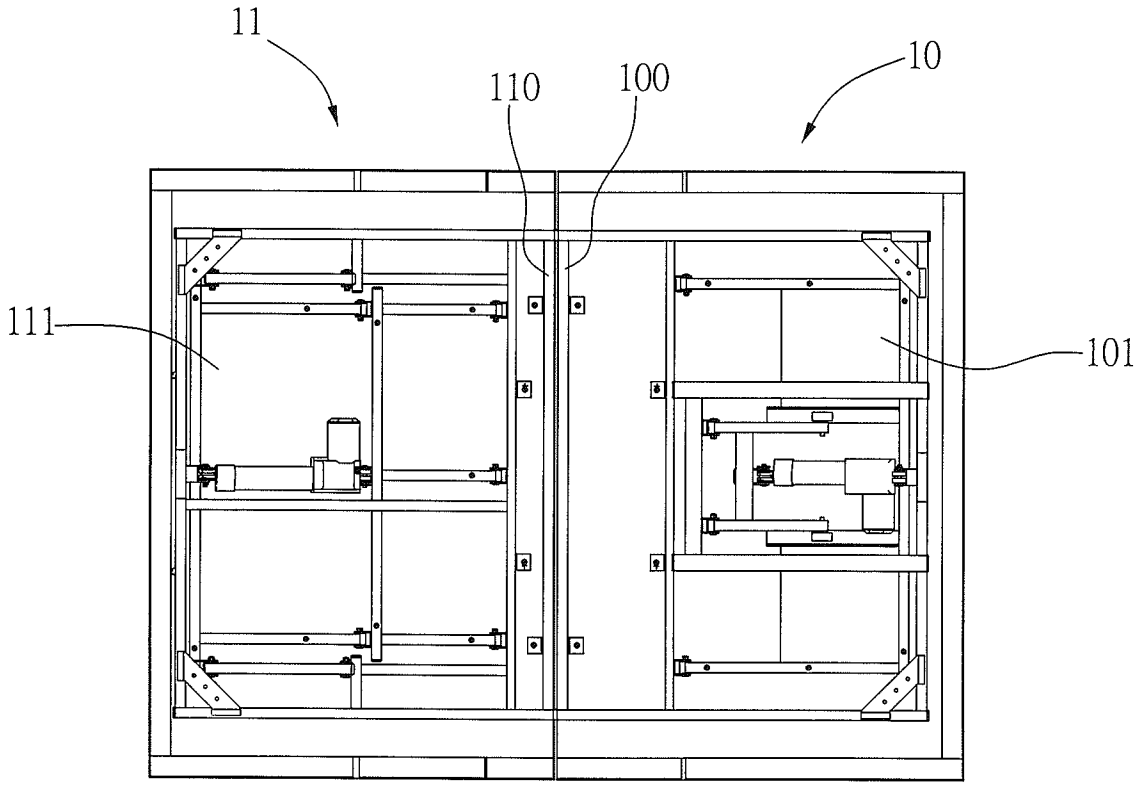
FIG. 4 is a schematic assembly view of the bottom bed combination as shown in FIG. 1.

Referring to the drawings and initially to FIGS. 1-9, a bottom bed combination 1 in accordance with the preferred embodiment of the present invention comprises a first bed bottom 10, a second bed bottom 11, two fastening units 12 and a plurality of stands 13.

The first bed bottom 10 includes a first bed frame 100 and a first bed board 101. The first bed frame 100 is provided with a plurality of first bases 1000. The first bed frame 100 has a lower portion provided with a first linkage 1001 and a first electric cylinder 1002.

The second bed bottom 11 includes a second bed frame 110 juxtaposed to the first bed frame 100 and a second bed board 111 juxtaposed to the first bed board 101. The second bed frame 110 is provided with a plurality of second bases 1100. The second bed frame 110 has a lower portion provided with a second linkage 1101 and a second electric cylinder 1102.

Each of the two fastening units 12 includes a mount 120 mounted on the first bed frame 100 and the second bed frame 110, and a pin 121 extending through the mount 120, the first bed frame 100 and the second bed frame 110, to connect the first bed frame 100 and the second bed frame 110 by the mount 120.

The stands 13 are respectively secured on the first bases 1000 of the first bed frame 100, the second bases 1100 of the second bed frame 110 and the mount 120 of each of the two fastening units 12 by screwing.

In the preferred embodiment of the present invention, each of the two fastening units 12 includes more than one mount 120.

Figure 5:
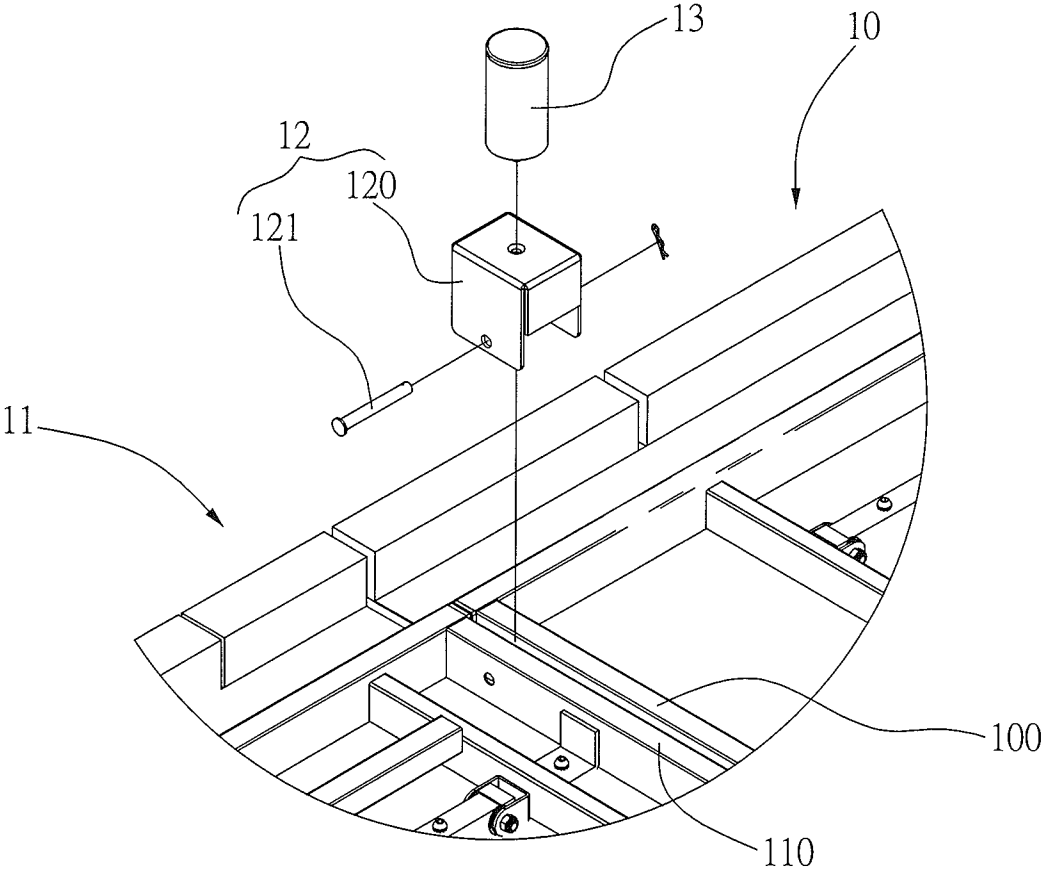
FIG. 5 is a locally enlarged view of the bottom bed combination as shown in FIG. 3.
Figure 6:
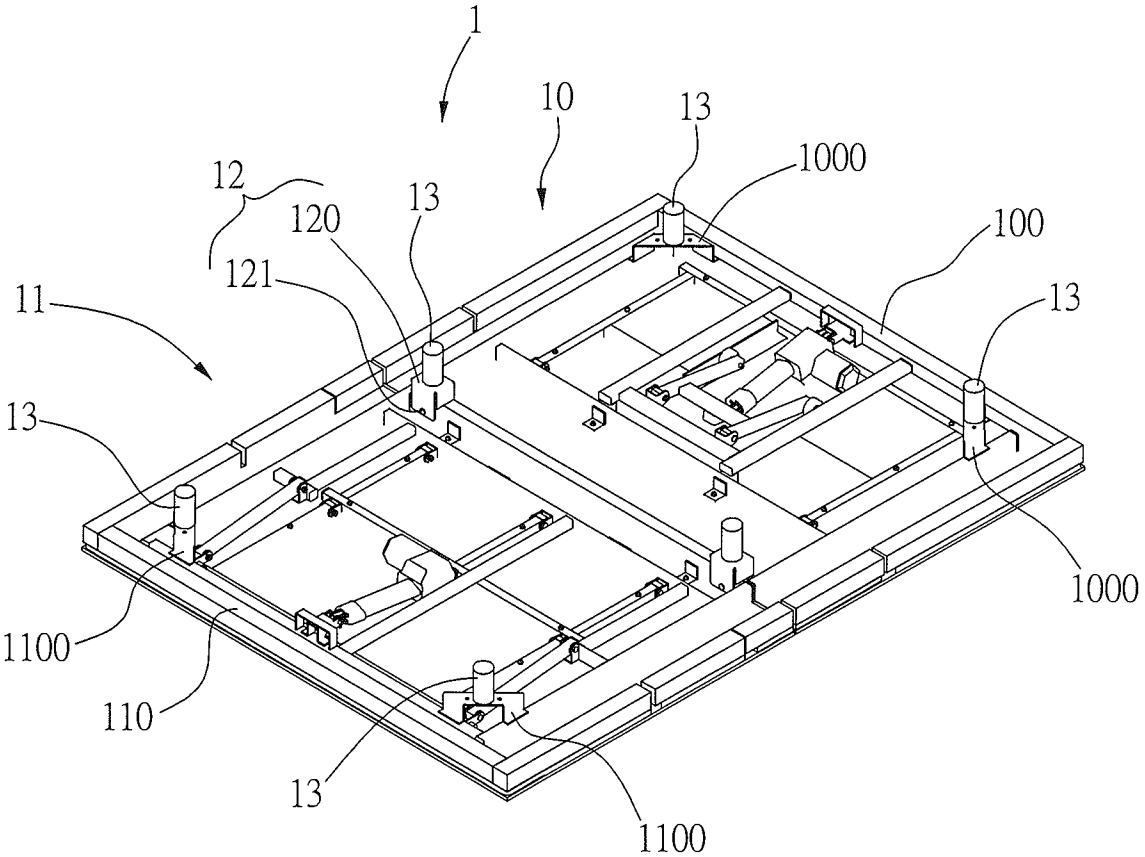
FIG. 6 is a bottom perspective view of the bottom bed combination in accordance with the preferred embodiment of the present invention.
Figure 7:
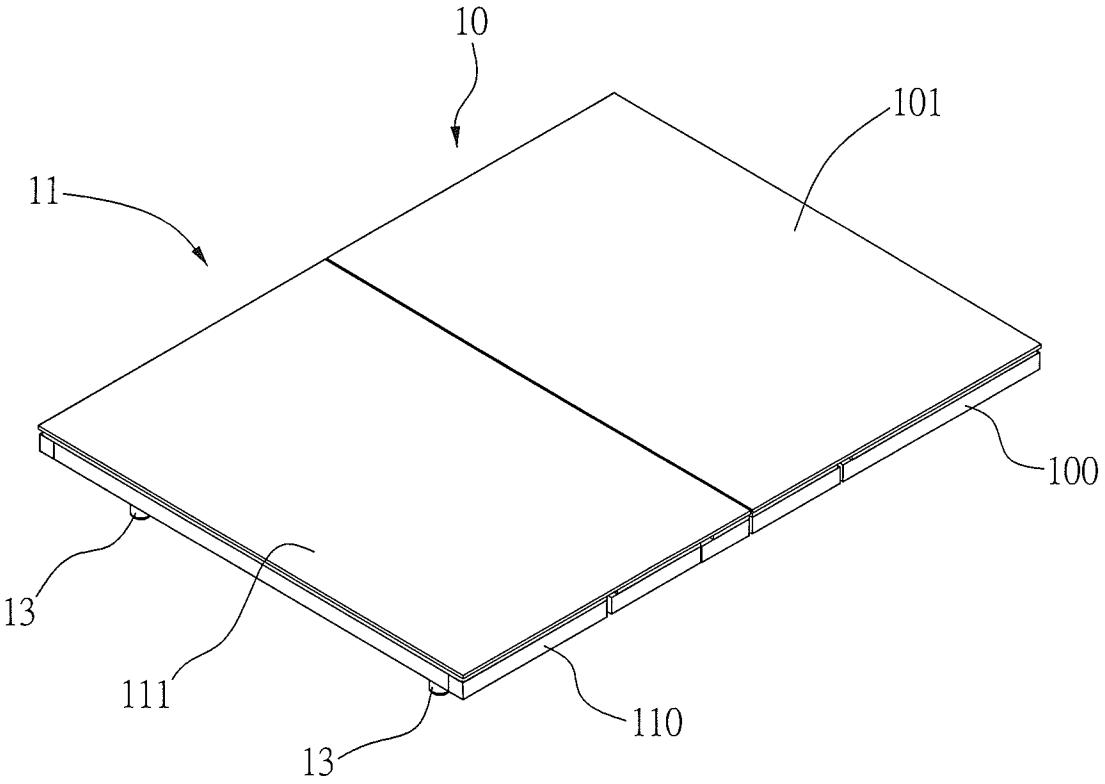
FIG. 7 is a top perspective view of the bottom bed combination in accordance with the preferred embodiment of the present invention.
Figure 8:
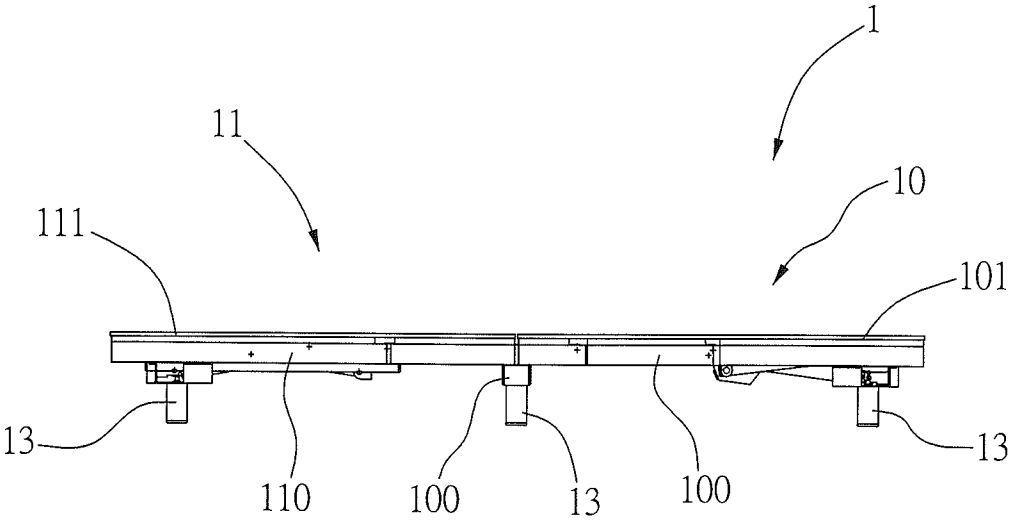
FIG. 8 is a front view of the bottom bed combination in accordance with the preferred embodiment of the present invention.

In assembly, referring to FIGS. 6-8 with reference to FIGS. 1-5, when the first bed bottom 10 and the second bed bottom 11 are arranged side by side, the second bed frame 110 of the second bed bottom 11 is juxtaposed to the first bed frame 100 of the first bed bottom 10 as shown in FIG. 5, and the second bed board 111 of the second bed bottom 11 is juxtaposed to the first bed board 101 of the first bed bottom 10 as shown in FIG. 7. Then, the mount 120 of each of the two fastening units 12 is mounted on the first bed frame 100 and the second bed frame 110, and the pin 121 of each of the two fastening units 12 extends through the mount 120, the first bed frame 100 and the second bed frame 110, to connect the first bed frame 100 and the second bed frame 110 by the mount 120 of each of the two fastening units 12 as shown in FIG. 6. Thus, the first bed bottom 10 and the second bed bottom 11 are combined together by the two fastening units 12. Then, the stands 13 are respectively secured on the first bases 1000 of the first bed frame 100, the second bases 1100 of the second bed frame 110 and the mount 120 of each of the two fastening units 12 by screwing to construct the bottom bed combination 1 as shown in FIG. 6.

Figure 9:
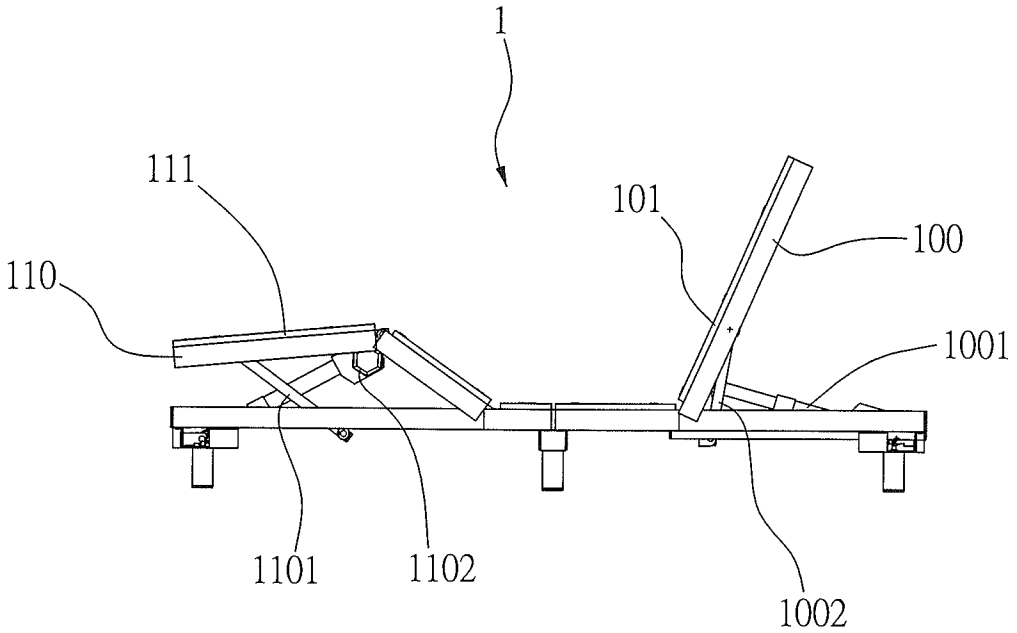
FIG. 9 is a schematic operational view of the bottom bed combination as shown in FIG. 8 in use.

In operation, referring to FIGS. 8 and 9 with reference to FIGS. 1-7, the first linkage 1001 is driven by the first electric cylinder 1002 to move (lift or lower) the first bed frame 100 and the first bed board 101 of the first bed bottom 10, and the second linkage 1101 is driven by the second electric cylinder 1102 to move (lift or lower) the second bed frame 110 and the second bed board 111 of the second bed bottom 11.

Accordingly, the first bed bottom 10 and the second bed bottom 11 are detached before assembly, to facilitate and decrease the cost of packaging, storage and transportation of the bottom bed combination 1. In addition, the first bed bottom 10 and the second bed bottom 11 are combined together by the two fastening units 12, so that the user can mount the bottom bed combination 1 by himself/herself. Further, the first bed bottom 10 and the second bed bottom 11 are assembled and disassembled easily and quickly, thereby facilitating the user assembling and disassembling the bottom bed combination 1.

Figure 10:
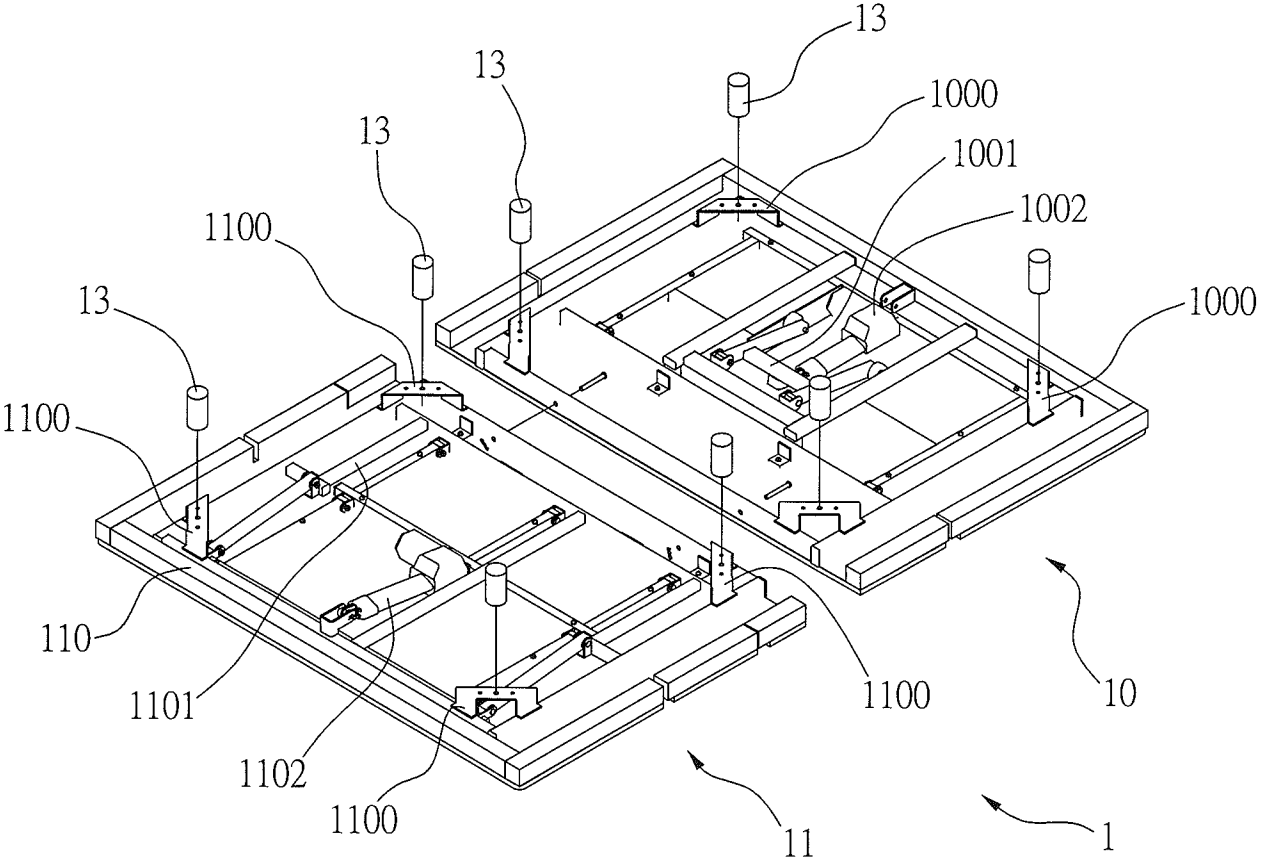
FIG. 10 is an exploded perspective view of a bottom bed combination in accordance with another preferred embodiment of the present invention.
Figure 11:
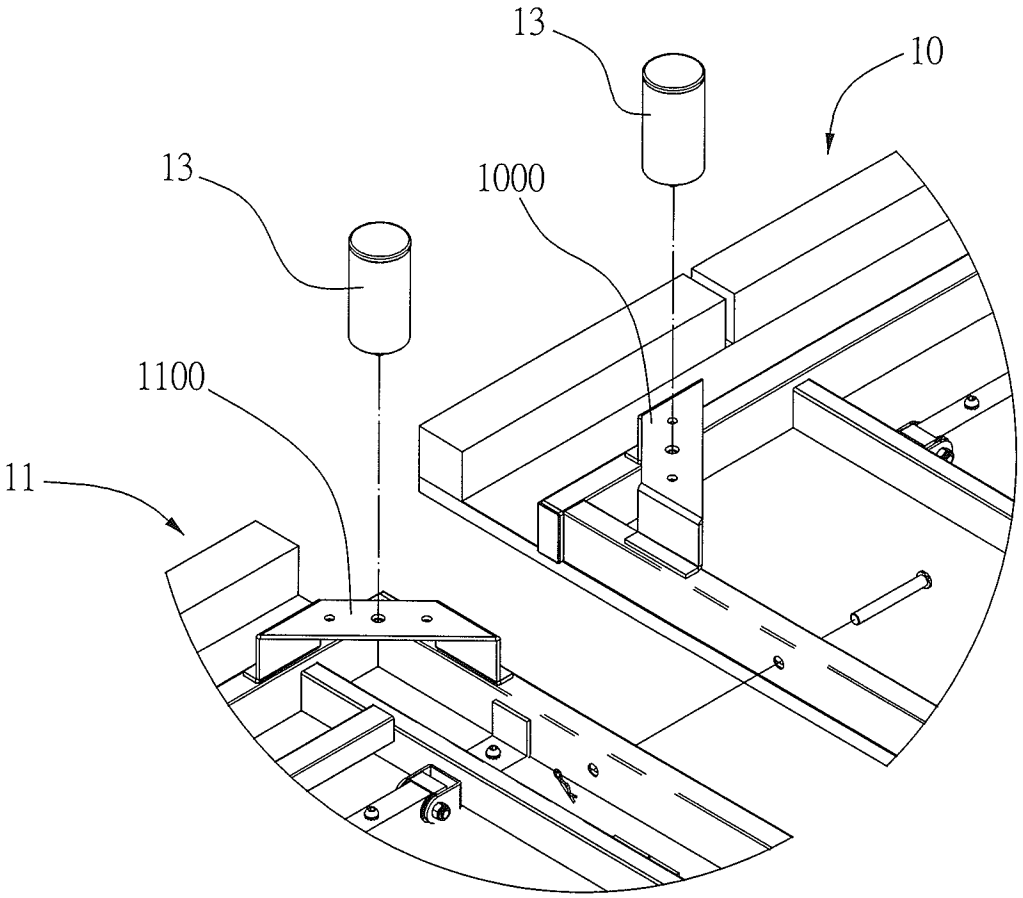
FIG. 11 is a locally enlarged view of the bottom bed combination as shown in FIG. 10.
Figure 12:
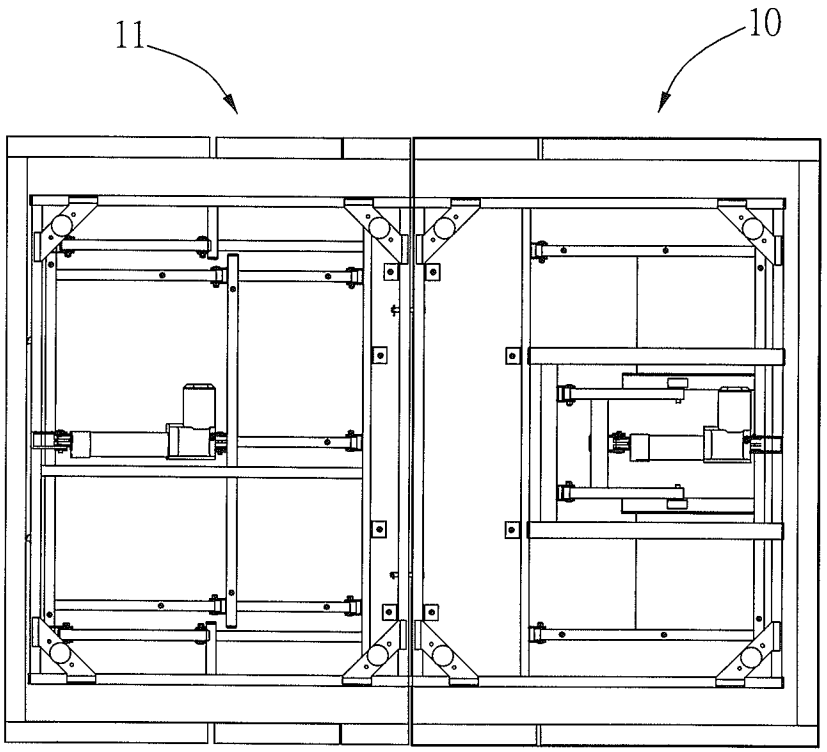
FIG. 12 is a bottom assembly view of the bottom bed combination as shown in FIG. 10.

Referring to FIGS. 10-12, the two fastening units 12 are undefined. The first bases 1000 are located at four corners of the first bed frame 100, and the second bases 1100 are located at four corners of the second bed frame 110. The stands 13 are respectively secured on the first bases 1000 of the first bed frame 100 and the second bases 1100 of the second bed frame 110 by screwing. In use, the first bed bottom 10 is juxtaposed to the second bed bottom 11 as shown in FIG. 12. Preferably, the first bed bottom 10 and the second bed bottom 11 are connected by pins.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A bottom bed combination comprising:

a first bed bottom, a second bed bottom, two fastening units and a plurality of stands;

wherein:

the first bed bottom includes a first bed frame and a first bed board;

the first bed frame is provided with a plurality of first bases;

the first bed frame has a lower portion provided with a first linkage and a first electric cylinder;

the second bed bottom includes a second bed frame juxtaposed to the first bed frame and a second bed board juxtaposed to the first bed board;

the second bed frame is provided with a plurality of second bases;

the second bed frame has a lower portion provided with a second linkage and a second electric cylinder;

each of the two fastening units includes a mount detachably mounted on the first bed frame and the second bed frame, and a pin extending through the mount, the first bed frame and the second bed frame, to connect the first bed frame and the second bed frame by the mount; and the stands are respectively secured on the first bases of the first bed frame, the second bases of the second bed frame and the mount of each of the two fastening units.

2. The bottom bed combination of claim 1, wherein each of the two fastening units includes more than one mount.

3. The bottom bed combination of claim 1, wherein the mount of each of the two fastening units has an inverted U-shaped configuration.

4. The bottom bed combination of claim 1, wherein the mount of each of the two fastening units has a first side located outside of the first bed frame and a second side located outside of the second bed frame.

5. The bottom bed combination of claim 4, wherein the first bed frame and the second bed frame are clamped between the first side and the second side of the mount of each of the two fastening units.

6. The bottom bed combination of claim 1, wherein the first bed frame and the second bed frame are received in a hollow formed in the mount of each of the two fastening units.

* * * * *